US011380291B2

(12) United States Patent
Colon

(10) Patent No.: US 11,380,291 B2
(45) Date of Patent: Jul. 5, 2022

(54) ADJUSTABLE COMPENSATED NUT FOR A STRINGED INSTRUMENT

(71) Applicant: Becket Colon, Drottningholm (SE)

(72) Inventor: Becket Colon, Drottningholm (SE)

( * ) Notice: Subject to any disclaimer, the term of this patent is extended or adjusted under 35 U.S.C. 154(b) by 0 days.

(21) Appl. No.: 17/023,876

(22) Filed: Sep. 17, 2020

(65) Prior Publication Data

US 2022/0084485 A1 Mar. 17, 2022

(51) Int. Cl.

| | |
|---|---|
| ***G10D 3/14*** | (2020.01) |
| ***G10D 3/06*** | (2020.01) |
| ***G10D 1/08*** | (2006.01) |
| ***G10D 3/22*** | (2020.01) |
| ***G10D 3/10*** | (2006.01) |

(52) U.S. Cl.

CPC ..... *G10D 3/14* (2013.01); *G10D 1/08* (2013.01); *G10D 3/06* (2013.01); *G10D 3/10* (2013.01); *G10D 3/22* (2020.02)

(58) Field of Classification Search

CPC .. G10D 3/14; G10D 3/10; G10D 3/06; G10D 3/22; G10D 1/08

See application file for complete search history.

(56) References Cited

U.S. PATENT DOCUMENTS

| | | | | |
|---|---|---|---|---|
| 4,295,404 | A | 10/1981 | Smith | |
| 4,867,031 | A | 9/1989 | Fender | |
| 5,404,783 | A | 4/1995 | Feiten et al. | |
| 5,481,956 | A | 1/1996 | Lojacono et al. | |
| 6,433,264 | B1 | 8/2002 | Gimpel et al. | |
| 2010/0005944 | A1* | 1/2010 | Eliasson | G10D 1/08 84/314 N |

* cited by examiner

*Primary Examiner* — Kimberly R Lockett

(74) *Attorney, Agent, or Firm* — Buchanan Ingersoll & Rooney PC

(57) ABSTRACT

An adjustable compensated nut system for a stringed musical instrument allows for improved intonation of each string of the instrument regardless of string gauge, desired tension, material, or construction. The adjustable compensated nut includes a seat which accepts one or more individual and interchangeable saddles featuring different intonation portions which have different dimensions which allow for achieving the desired pitch or intonation of each individual string of the instrument. Optimally, the number of intonation portions is equal to the number of strings of the instrument, and each particular intonation portion is dimensioned to improve the intonation of a particular string according to string tension and properties. Advantageously, the saddles of the nut are interchangeable and so that it is possible to adjust the degree of compensation to correspond with string choice.

20 Claims, 10 Drawing Sheets

ADJUSTABLE COMPENSATED NUT FOR A STRINGED INSTRUMENT

BACKGROUND

1. Field of the Invention

The present invention generally relates to a nut for a stringed musical instrument and, in particular, to an adjustable compensated nut for fretted stringed instruments such as a guitar or a bass guitar.

2. Description of Related Art

Proper intonation of stringed musical instruments is very difficult to achieve. The strings of fretted string instruments are generally not properly intonated and, in fact, it is generally considered not possible to perfectly tune a conventional guitar without individual compensation based upon the gauge and tension of the string.

Stringed instruments typically have multiple strings tuned at different pitches. The acoustical characteristics of the different strings are dependent upon many different factors such as the gauge or diameter of the string, the tension of the string, whether the string is wound or plain, the material of the string, the material, shape and dimensions of the string core, additional variables include whether the string is coated with anti-corrosion or friction minimizing coatings, or is cryogenically treated. All of these variables affect the acoustic properties of the string.

Standard fretted instruments such as guitars and bass guitars feature a series of frets positioned along the neck. The frets are ridges of material which extend outwardly and generally perpendicularly across the finger board of the guitar and each fret determines the pitch of the note produced.

The placement of the frets is approximate in order to accommodate all of the different strings and is therefore imprecise, it does not result in perfect intonation of each string at each fret location.

The strings of fretted instruments vary greatly in construction, material, treatment and in addition come in a variety of different gauges or diameters. Typically, strings are sold in pre-packaged string sets which feature string gauges which increase in relative gauge to complete the set. Each manufacturer has their own formula to achieve a "balanced" tone. Strings are commonly marketed as extra light, light, medium, heavy, etc.

The choice of string gauge, material and construction is individual and vary significantly, for example, an extra light string gauge for electric guitars usually features a pre-configured selection of string gauges from 0.008 in to 0.038 in, while a heavy gauge string set configuration includes strings 0.012 in to 0.054 in. Pre-configured strings sets also vary from manufacturer to manufacturer, so a light gauge set from one brand might offer different gauge strings than another.

Some players prefer a more balanced string set with even gauge intervals between strings while others prefer string sets with an asymmetric string gauges thinner plain strings and thicker wound strings.

Bass guitar strings typically vary from 0.030 up to 0.180 for the thickest or "heaviest" strings. Many players regardless of the choice of instrument like to switch between string gauges, materials, brands which further complicates the issue.

In reality there are an endless number of variables one must take account for when determining the correct amount of compensation which is why any fixed degree of compensation at the nut will remain approximate and not precise.

One size fits all doesn't work. Scale length, string gauge, desired pitch, materials and construction all affect the fretted instruments intonation and therefore it must be possible to adjust or compensate between different string configurations.

Another variable in being able to maintain proper tuning with existing musical instrument is the material of the nut itself. Traditional nut materials include bone, but nuts can also be constructed from other materials such as plastic, standard glass filled plastic, ivory, graphite, composite materials, and metal.

Each material having different mechanical and tribological properties which affect tone and the strings ability to move smoothly in the string grooves found on the nut.

In fact, some players prefer metal due to its hardness and density, the hard and dense material transferring more energy into the neck and body of the instrument which offers improved tonal characteristics. However, metal nuts have a tendency to bind strings.

This is why some players on prefer nuts featuring lubricated, glass filled composite materials, which are hard but which help the instrument stay in tune by minimizing the propensity of the string to fasten and wedge itself in the nut groove which changes the strings pitch, this is a common occurrence due to repeated string movement when playing and bending strings.

There exists therefore a compromise between nut materials typically hardness and density vs tribology. Improved tone vs the ability to stay in tune.

In order to improve intonation, conventional guitars and bases usually include an adjustable bridge to improve the tuning of the guitar. For example, U.S. Pat. No. 4,867,031 issued to Fender discloses an adjustable bridges which allow individual strings to be adjusted and intonated. The adjustable bridges provide a means for allowing each string to be adjustably compensated according to its length, tension, and properties.

U.S. Pat. No. 5,404,783 issued to Feiten, et al., discloses an adjustable bridge and individual adjustable saddles. Each saddle is located in a groove and each saddle includes a threaded screw. The screws are connected to a transverse boss mounted perpendicular to the strings. Turning a screw causes the connected saddle to move which adjusts the intonation of that string. The Feiten patent is complicated and difficult to understand. Players need expensive and accurate strobe tuners, testing, and continuous adjustment of each individual string to achieve proper intonation.

U.S. Pat. No. 6,433,264 issued to Gimpel, et al., discloses a compensated nut for stringed instruments. The nut includes individual compensated saddles featuring an overhang or extending portion that extends over a portion of the finger board. This overhang portion is fixed to a specific string gauge, tension, construction, and material. Disadvantageously, this device is only a compromise solution because the extended portion of the nut does not account for strings with different core sizes and diameters and is therefore only adequate for only specific fixed string gauges which unfortunately are not disclosed by the manufacturer. It is not clear which particular strings gauges, materials, or constructions the nut is compensated for, this limitation prohibits the player from being able to know if the instrument is properly intonated to begin with. Furthermore, the fixed degree of compensation prohibits the ability to simply switch between desired string gauges, constructions, and materials. If players want to use a different string gauge, or change string material, they must replace the entire nut.

U.S. Pat. No. 5,481,956 issued to LoJacono, et al., discloses a guitar tuning apparatus with an adjustable bridge including both an adjustable saddle bridge member and a nut featuring adjustable nut saddle members. The adjustment of both the bridge and nut determines the length of each string and the longitudinal position of each string. In particular, the adjustable bridge has the plurality of adjustable saddle members secured to the body of the guitar and the nut is adjustable to achieve a sinusoidal configuration by adjusting the position of the nut saddle members mounted in a nut frame. The number of saddles in the nut and bridge correspond to the number of strings of the guitar, and the bridge and saddle members are adjusted to establish as true an intonation of each string as possible. The LoJacono patent, however, discloses a complex structure with multiple parts that requires adjustment of each individual string at both the nut and bridge of the guitar. Disadvantageously, this complex structure is subject to rattles, goes out of tune, and requires adjustments each time one changes string gauges, material, or construction.

U.S. Pat. No. 4,295,404 issued to Smith discloses a compensated nut for a lute-type instrument. The nut includes an overhang or extending portion that extends over a portion of the finger board and the overhang portion is tapered to give greater compensation to the strings of wider diameter. Disadvantageously, this device is only a compromise solution the device does not account for strings with different core sizes and diameters.

SUMMARY

A need therefore exists for a compensated nut system which allows players the means whereby they can easily adjust instrument intonation regardless of desired tension and string choice and which eliminates the above-described problems.

One aspect of the disclosure involves a compensated nut for a stringed musical instrument with a body, a neck with or without frets and one or more strings. The compensated nut includes a base (also referred to interchangeably hereinafter as a seat) featuring an elongated body with a front side, a back side, a top side, and a bottom side, and the elongated body is configured to extend across at least a portion of the neck of the instrument. The nut seat also includes geometry to accept a one or more intonation saddles featuring matching geometry to mate it on top of the nut seat as a group or as individual saddles each saddle featuring intonation portions with different dimensions according to the desired pitch or intonation of the instrument. Desirably, the number of intonation portions is equal to the number of strings of the instrument, and each intonation portion is sized and dimensioned to improve the intonation of a particular string regardless of dimension, tension, material or construction.

In one embodiment the nut seat can be mounted into a groove cut in to an area near the end of the fretboard such as found on fender brand or fender type guitars an another embodiment the nut seat can be mounted forward facing and perpendicular to the end of the fretboard resting on the headstock of the guitar such as found on Gibson and other brand guitars.

In one embodiment, the intonation portions on the saddles desirably comprise molded or milled sections. The cut-out sections include a first side wall and a second side wall. The side walls are preferably generally parallel and joined by a lower surface. More preferably, the side walls are between about 0.0001 inches (0.0025 cm) and about 0.200 inches (0.508 cm) in length, and the walls extend to the top surface of the nut. The compensated nut saddles desirably includes a slot for each string of the instrument and each slot is preferably located within a properly dimensioned cut-out section.

The present disclosure involves a compensated nut which improves the intonation of each string of a musical instrument regardless of string gauge, tension, construction and material. Advantageously, the nut saddle/saddles are compensated different amounts and interchangeable according to the desired pitch of a particular string. The compensated nut is suitable for use with a wide range of different string gauges, desired tensions, construction and materials for the most popular types of stringed musical instruments, the interchangeable saddle components clearly identified as to which string gauges, desired tension, material and construction they are best suited for. Because the saddles can easily be replaced or interchanged to accommodate different string properties, the player is not limited to fixed intonation values found in both standard nuts and standard fixed compensated nuts but is able to improve and maintain optimal intonation regardless of the choice of string tension and properties by simply interchanging the correct nut saddle component.

Another aspect of the present disclosure is a guitar or bass with a body, neck, a bridge, and an adjustable compensated nut. Further aspects involve an aftermarket guitar or bass neck featuring a factory mounted adjustable compensated nut. The compensated nut assembly compromising an elongated seat body which extends across at least a portion of the neck assembly and featuring geometry in which to mount the saddle components.

Compensated nuts according to exemplary embodiments are advantageously simple to manufacture because it consists of a molded or milled single solid base component which accepts molded or machined saddle components.

The nut can be constructed from standard materials such as plastic, glass filled plastic, graphite, composite materials, metal, resin, and other hard and low friction materials. In an exemplary embodiment the adjustable compensated nut is produced with 30% to 60% long fiber glass, carbon or aramid fiber reinforced, heat, UV stabilized and lubricated engineering resins such as PA66 and PEEK, which offer the benefits of both hardness/density and lubrication. Long fiber reinforced engineering resins offering improved hardness vs standard short fiber, glass powder filled plastic resins.

Further, in contrast to the designs of conventional intonating devices, the compensated nut according to exemplary embodiments allows an unprecedented ability to achieve a more reliable and better sounding and playing instrument regardless of string choice. Thus, the compensated nut offers more choices and improves both the reliability and sound of the instrument.

The compensated nut according to exemplary embodiments is not only practical of the ease of manufacturing, it is also simple in terms of installation, after market installation and use. It is understood that the compensated nut according to exemplary embodiments can be used to improve the tuning of many different types and configurations of guitars, basses and it can be used with other types of lute or stringed instruments.

Significantly, the compensated nut according to exemplary embodiments is easy to service and maintain because there are not moving parts and can easily be used and configured by the player. Additionally, existing guitars can be readily retrofitted with the compensated nut assembly, Further, the compensated nut assembly allows for unprecedented choice and is simple for the user to modify or optimize intonation according to the type of instrument by choosing a saddle configuration or individual saddles suitable and preconfigured for scale length and all of the different string gauges, desired tensions, construction and materials in the marketplace.

Further aspects, features and advantages of the present invention will become apparent from the detailed description of the exemplary embodiments that follows.

BRIEF DESCRIPTION OF THE DRAWINGS

The appended drawings contain figures of a exemplary embodiments of the adjustable compensated musical instrument nut. The above-mentioned features of the adjustable compensated musical instrument nut, as well as other features, will be described in connection with the exemplary embodiments. However, the illustrated embodiment is only intended to illustrate the invention and not limit the invention. The drawings contain the following figures.

DETAILED DESCRIPTION

The present invention involves an adjustable compensated nut for a stringed instruments such as guitars and bass guitars. In the present embodiment, the nut is a comprised of a seat and a saddle component/components. The principles of the present invention, however, are not limited to guitars or basses. It will be understood that, in light of the present disclosure, the compensated nut disclosed herein can be successfully used in connection with other types of stringed musical instruments.

There exists compensation calculators which help to determine the optimal amount of compensation based upon string gauge, tension and properties however experimentation and testing is the preferred method of determining the particular sizing and degree of compensation for each instrument, instrument scale length, string type, tuning, and string properties. The embodiments disclosed below are for an adjustable compensated nut which the inventors constructed.

A detailed description of the compensated nut now follows.

Figures 1, 2, 3:
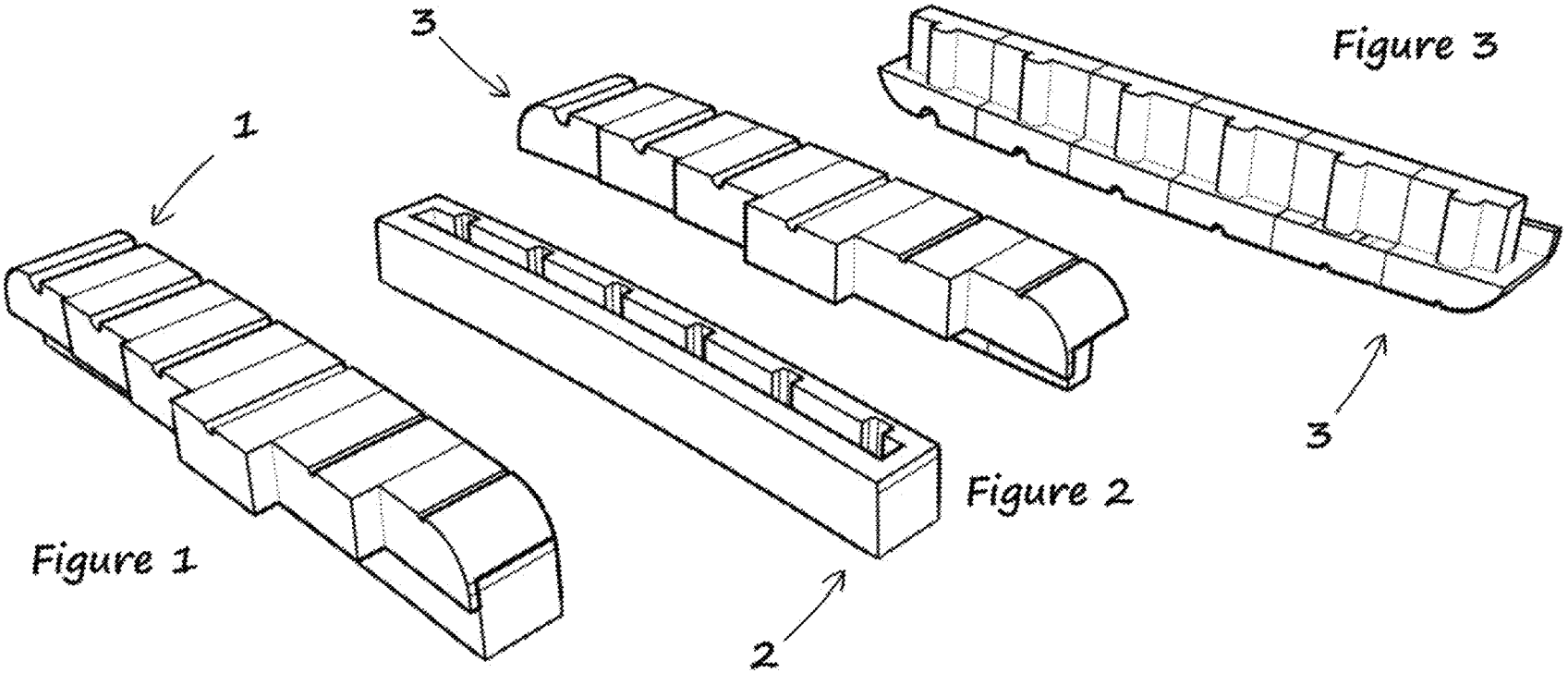
FIG. 1 is a perspective view of an assembled adjustable compensated nut featuring a female seat geometry and a pre-configured saddle with male fittings for all the strings on the instrument.
FIG. 2 is a exploded view of a disassembled adjustable compensated nut per FIG. 1, showing both the female geometry of the seat and the corresponding male geometry of a pre-configured saddle set, a preferred embodiment of the present invention for those wanting a saddle which is pre-configured for a specific string gauges and which encompasses all the strings of the instrument.
FIG. 3 is a perspective view of a saddle in the upside-down position to show the detail of the corresponding male geometry per FIG. 1

As seen in FIG. 1, the basic configuration of an assembled adjustable compensated nut 1. string slots are molded or cut into the saddle parts but it is possible to supply saddles without any groove cut into them.

The grooves in the saddles can vary in size, preferably from 0.008 in up to 0.0060 in in case of guitars but with other instruments string gauges can vary of to 0.200 in the case of bass guitar instruments.

The adjustable compensated nut parts can be designed, produced and assembled using a variety of fitting methods, a tongue and groove fitting featuring the female geometry for the seat and male geometry for the saddles in the exemplary embodiment will provide the most effective mating and contact between seat and saddle parts as the seat generally has more material than the saddles.

The shape and geometry of the fittings between the seat and the saddles, be it female to male, male to female or slot type fittings can vary in size, shape and geometry and are not limited to the geometry that is has been illustrated in the diagrams, what's important is the geometries match and mate with each other adequately and achieve a solid and firm connection with each other.

The adjustable compensated nut as seen in FIG. 1, FIG. 4, FIG. 7, FIG. 10, FIG. 13 and FIG. 16 is configured to accept 6 strings however it should be understood that the nut may have any number of slots depending, for example, upon the number of strings of the instrument.

Figures 16, 17, 18:
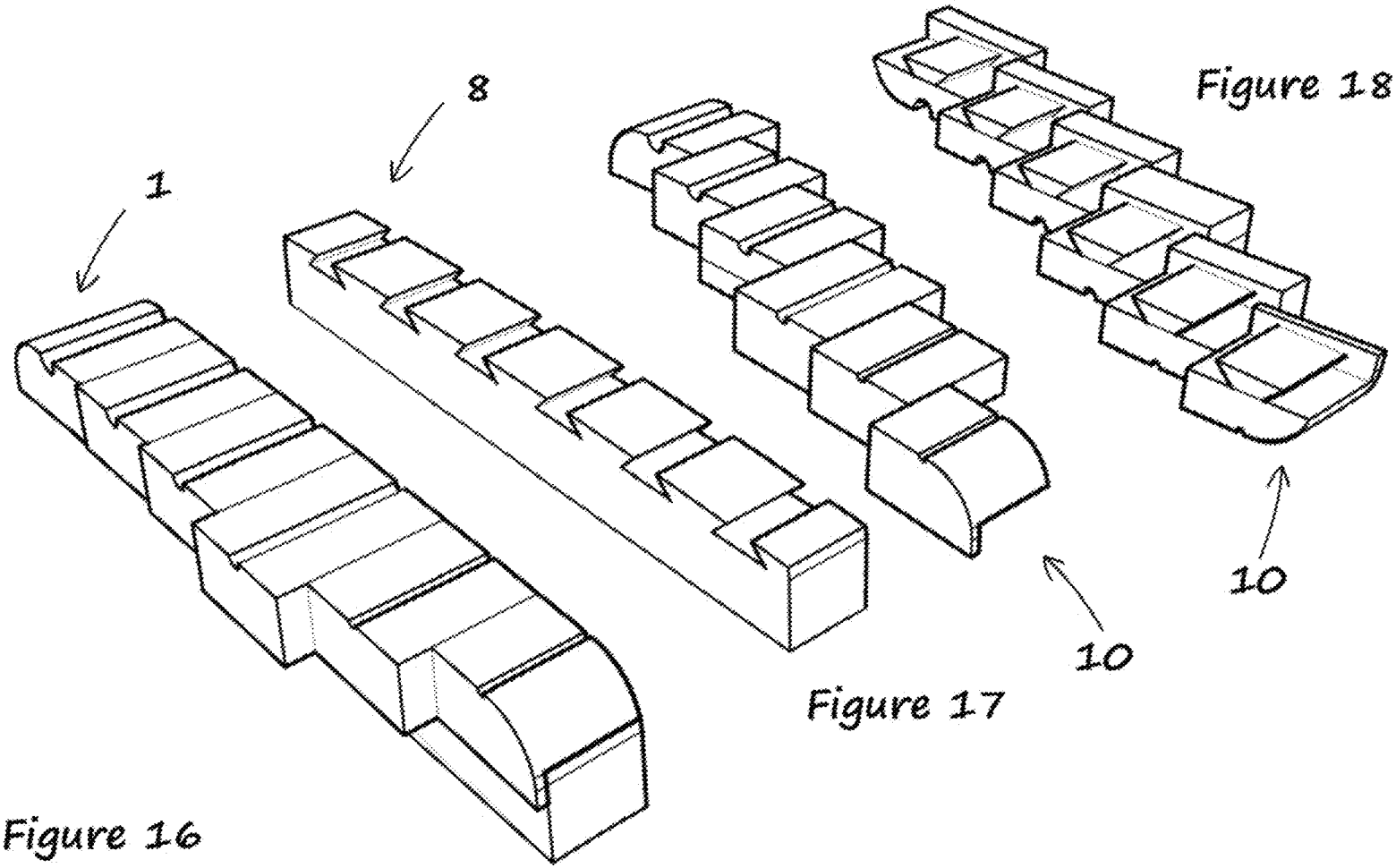
FIG. 16 is a perspective view of an assembled adjustable compensated nut with individual saddles featuring a slot type geometry seat and individual saddles with matching slot geometry.
FIG. 17 is an exploded view of an adjustable compensated nut with individual saddles per FIG. 16 showing the slot type geometry of the seat and the individual saddles.
FIG. 18 is a perspective view of the individual saddles in the upside-down position to show rear view of the corresponding slot type geometry of the individual saddles per FIG. 16.
Figure 19:
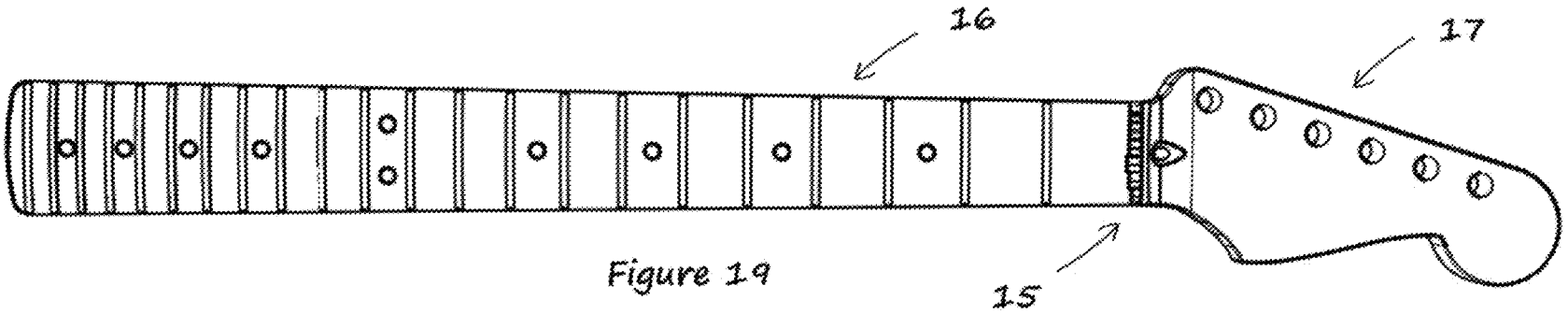
FIG. 19 shows an after-market guitar neck with a pre-installed adjustable compensated nut according to an embodiment of the present invention.
Figure 20:
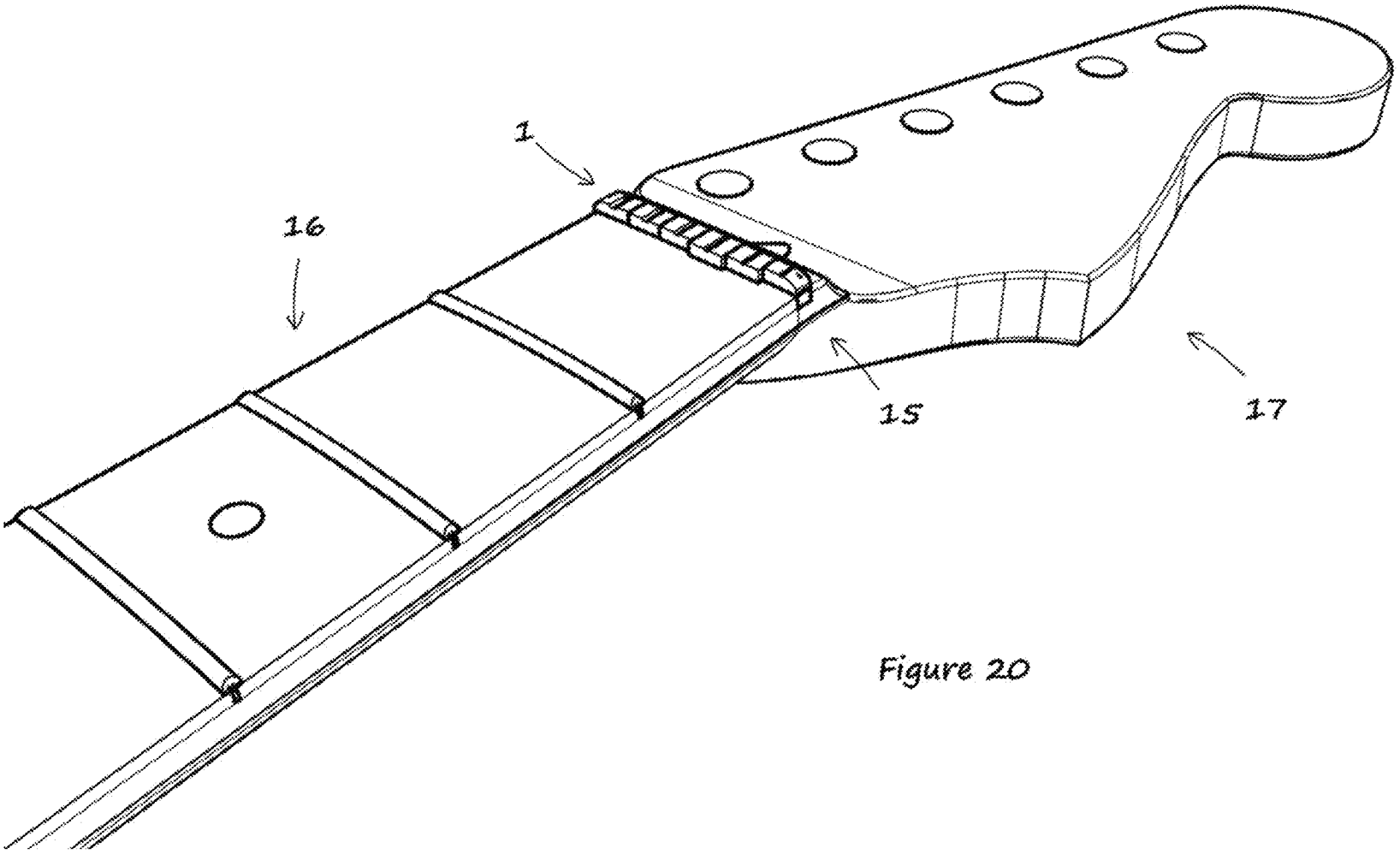
FIG. 20 shows headstock detail of after-market guitar neck per FIG. 19.
Figure 21:
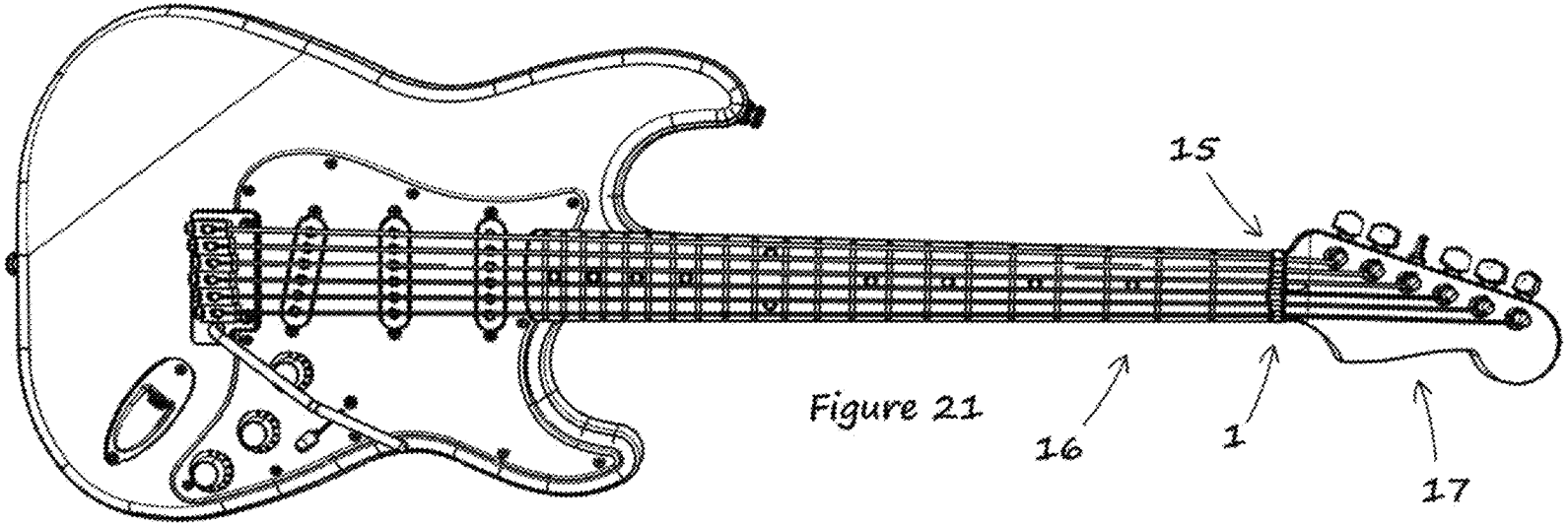
FIG. 21 shows a guitar having an after-market guitar neck per FIG. 19.

As seen in FIG. 1, FIG. 4, FIG. 7, FIG. 10, FIG. 13 and FIG. 16 the assembled compensated nut assembly is dimensioned to be mounted in a slot 15 at the end of the guitar necks fingerboard 16 close to the headstock 17 as seen in FIG. 19, FIG. 20 and FIG. 21.

Figures 4, 5, 6:
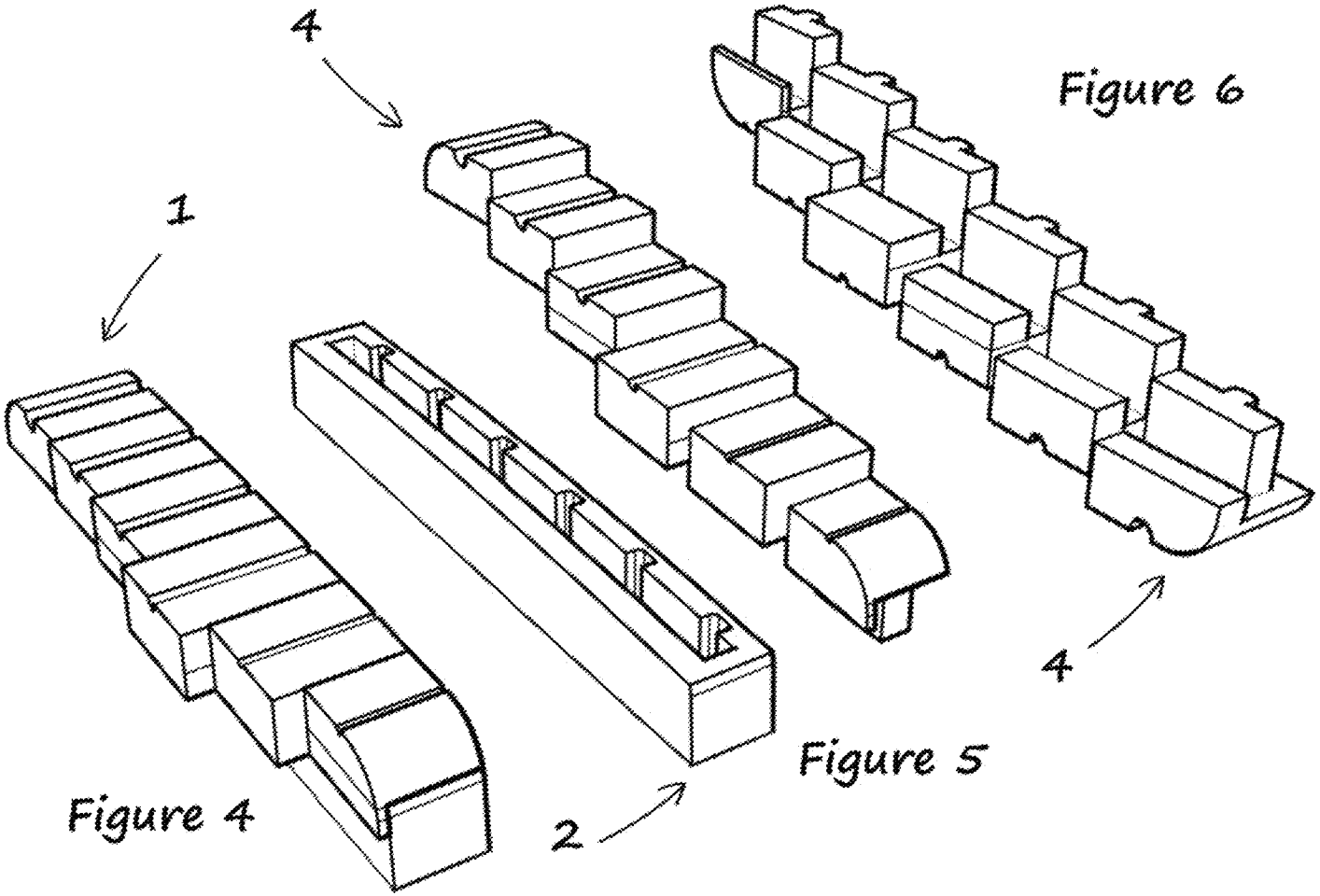
FIG. 4 is a perspective view of an assembled adjustable compensated nut with individual saddles with female geometry seat and male geometry saddles.
FIG. 5 is an exploded view of an adjustable compensated nut with individual saddles per FIG. 4 showing both the female geometry of the seat and the corresponding male geometry of the individual saddles, a preferred embodiment of the present invention for those wanting a compensated nut with saddles which allow individual compensation of each string.
FIG. 6 is a perspective view of a saddle in the upside-down position to show rear view of the corresponding male geometry on the individual saddles per FIG. 4.

As seen in FIG. 1, FIG. 2 and FIG. 3 the exemplary embodiment of the adjustable compensated nut, an assembled nut 1, the nut seat 2 featuring female geometry which accepts both male pre-configured saddle 3 encompassing all of the strings of the instrument or male individual saddle parts 4 as seen in FIG. 5 and FIG. 6.

As seen in FIG. 4, FIG. 5 and FIG. 6 one sees the assembled adjustable compensated nut 1, the female seat 2 and the individual saddle parts 4.

Figures 7, 8, 9:
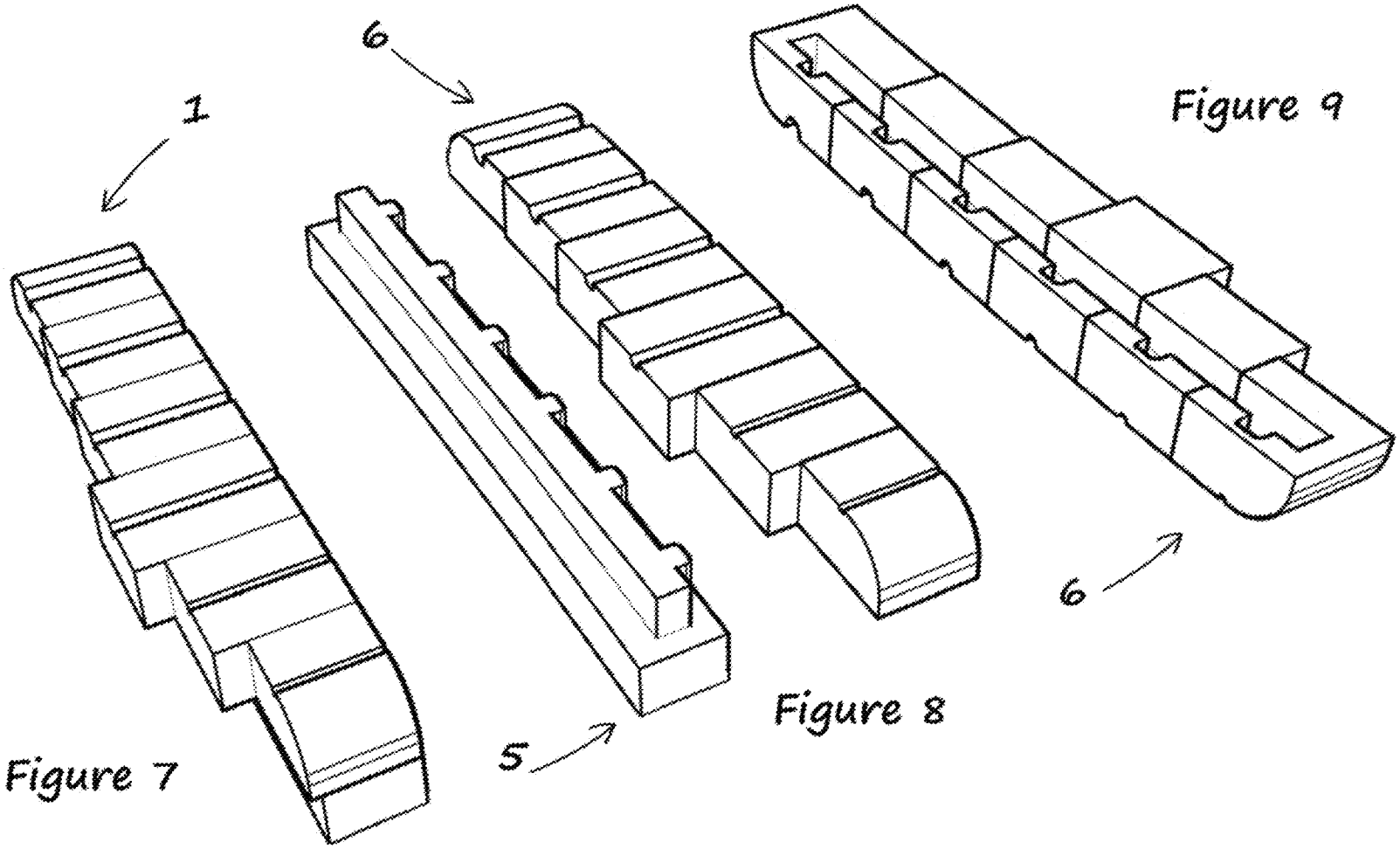
FIG. 7 is a perspective view of an assembled adjustable compensated nut with a pre-configured saddle for all the strings on the instrument featuring a male geometry seat and female geometry saddles.
FIG. 8 is an exploded view of an adjustable compensated nut with a pre-configured saddle set per FIG. 7 showing both the male geometry of the seat and the individual saddles.
FIG. 9 is a perspective view of a saddle in the upside-down position to show rear view of the corresponding female geometry on a pre-configured saddle set per FIG. 7.

As seen in FIG. 7, FIG. 8 and FIG. 9 one sees the assembled adjustable compensated nut 1, the male seat 5 and the female pre-configured saddle part 6.

Figures 10, 11, 12:
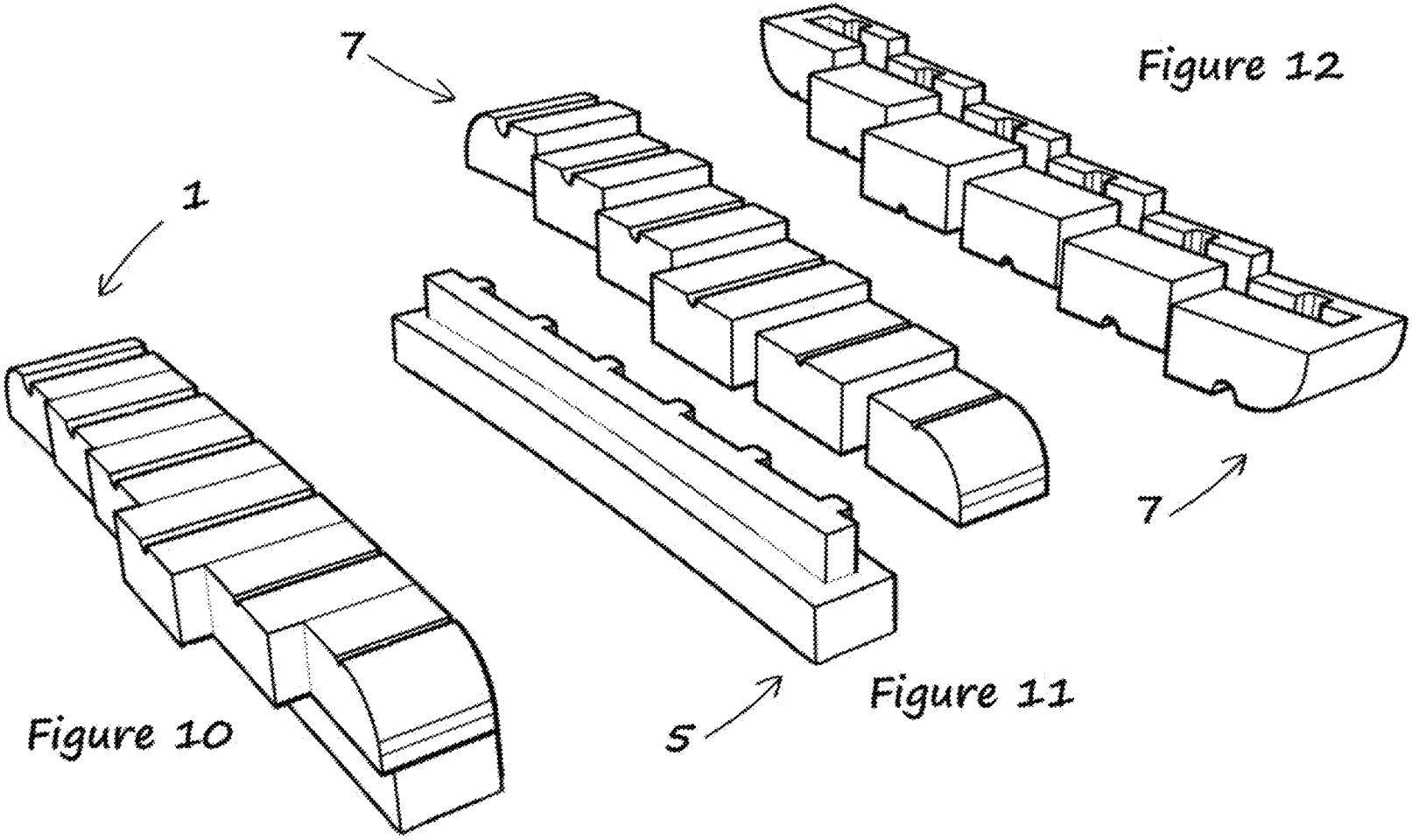
FIG. 10 is a perspective view of an assembled adjustable compensated nut with individual saddles with male geometry seat and the individual saddles which allow individual compensation of each string.
FIG. 11 is an exploded view of an adjustable compensated nut with individual saddles per FIG. 10 showing both the male geometry of the seat and the individual saddles.
FIG. 12 is a perspective view of the individual saddles in the upside-down rear position showing the corresponding female geometry on the individual saddles per FIG. 10.

As seen in FIG. 10, FIG. 11 and FIG. 12 one sees the assembled adjustable compensated nut 1, the male seat 5 and the female individual saddle part 7.

Figures 13, 14, 15:
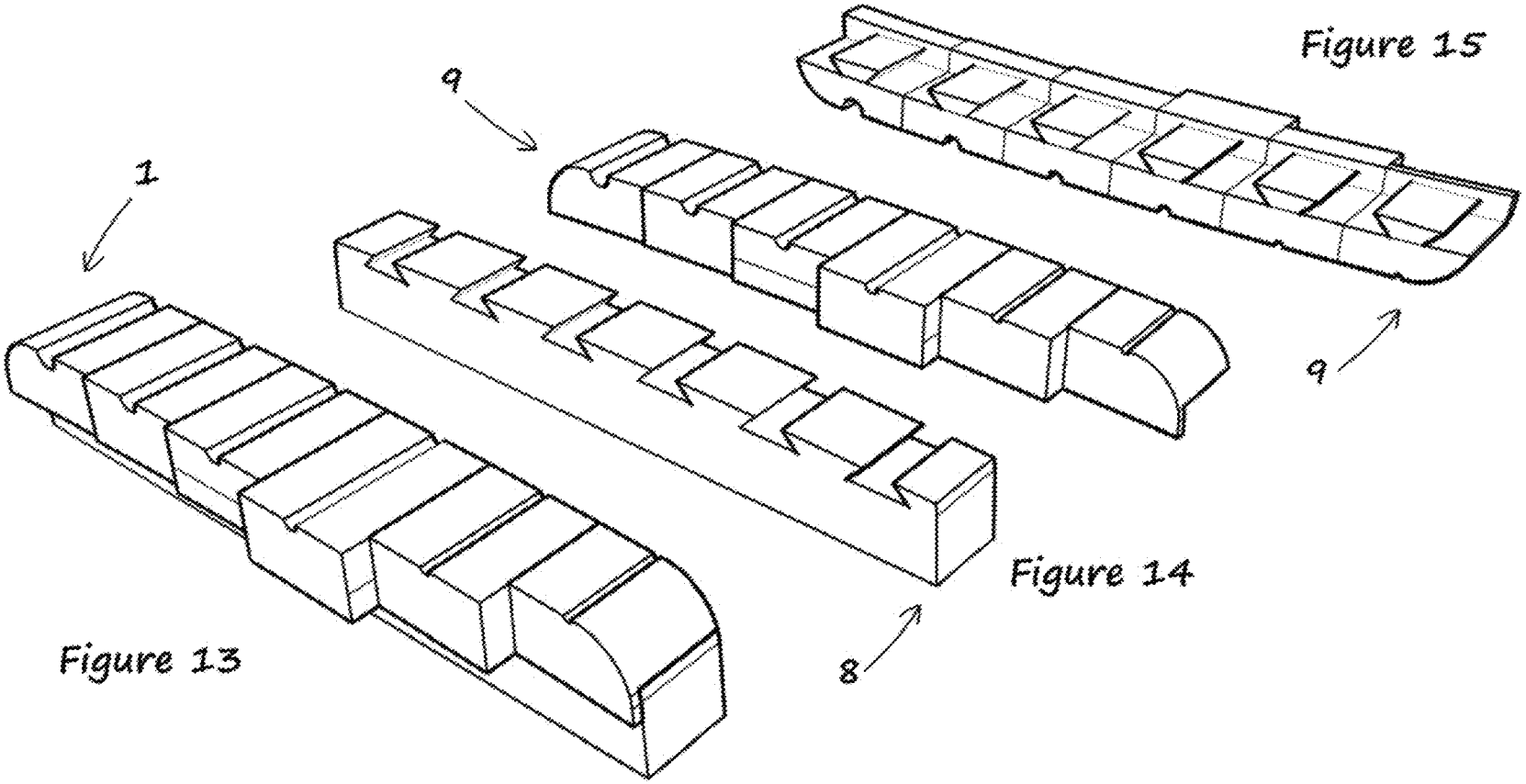
FIG. 13 is a perspective view of an assembled adjustable compensated nut with a pre-configured saddle featuring a slot type geometry seat with matching slot geometry pre-configured saddle for all the strings on the instrument.
FIG. 14 is an exploded perspective view of an adjustable compensated nut with a pre-configured saddle for all the strings on the instrument featuring a slot type geometry seat and pre-configured saddle per FIG. 13.
FIG. 15 is a perspective view of a pre-configured saddle in the upside-down position to illustrate the rear view of the corresponding matching slot type geometry on the pre-configured saddle per FIG. 13.

As seen in FIG. 13, FIG. 14 and FIG. 15 one sees the assembled adjustable compensated nut 1, the slot type seat 8 and the slot type pre-configured saddle part 9.

As seen in FIG. 16, FIG. 17 and FIG. 18 one sees the assembled adjustable compensated nut 1, the slot type seat 8 and the slot type individual saddle part 10.

As seen in FIG. 19 and FIG. 20 an aftermarket neck featuring a pre-mounted assembled compensated nut 1.

As seen in FIG. 21 a guitar with a pre-mounted assembled compensated nut 1 factory installed. The instrument however can be an acoustic guitar or bass, an electric guitar or bass, a ukulele or any other stringed instrument which typically uses a nut.

Figure 22:
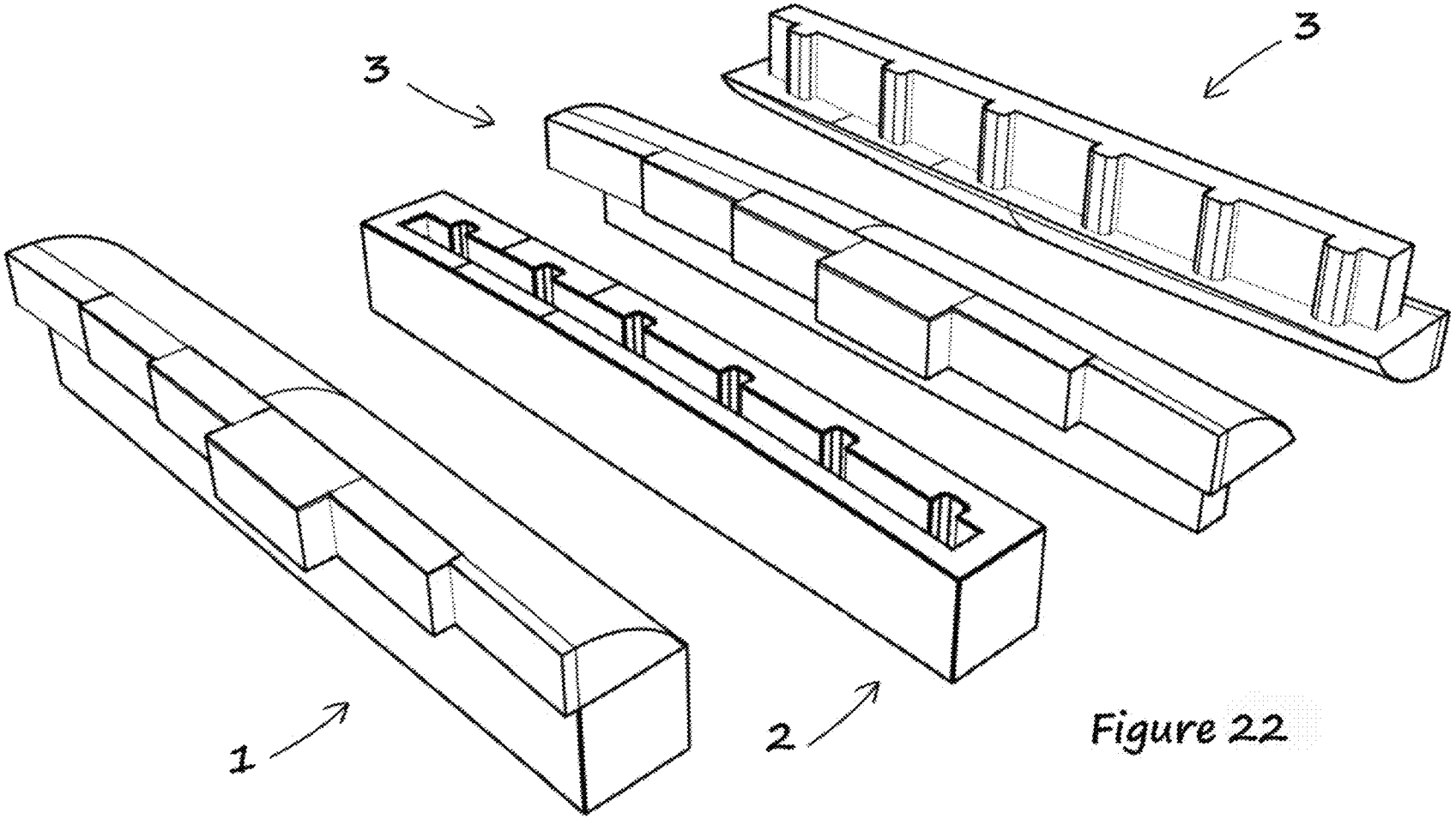
FIG. 22 shows an embodiment of an adjustable compensated Gibson style nut.

FIG. 22 illustrates a variation in which a nut is a Gibson style compensated nut. Shown here in a version without precut string slots. This style of nut is mounted behind the fretboard, while the other disclosed variations are all mounted into a groove in the fretboard.

As discussed above, a given compensated nut is designed for a specific scale length and string set at special tuning, but by applying the principles of the invention disclosed herein, different scale lengths with different amounts of compensation could be determined. Thus, a compensated nut may be manufactured with particular dimensions and sizes for a particular instrument or desired sound, and a different compensated nut may be constructed with different dimensions for different instruments and/or desired sounds. The nut of the guitar can be used alone or in combination with other devices, such as various bridges. In addition, the nut need not be entirely solid, and the principles of the present invention could be incorporated into a multi-piece nut.

Furthermore, although the invention described above is described in terms of a compensated nut, for stringed instruments with a "zero" fret and separate string guides, the zero fret could incorporate the compensated features described for the nut.

Although this invention has been described in terms of certain exemplary embodiments, other embodiments apparent to those of ordinary skill in the art are also within the scope of this invention. Accordingly, the scope of the invention is intended to be defined only by the claims which follow.

What is claimed is:

1. An adjustable compensated nut for a stringed instrument, the stringed instrument having one or more strings, a body and a neck, the nut comprising: one or more string saddles; an elongated nut base having a length sufficient to extend across at least a portion of the neck of the stringed instrument; a fitting on the tip of the base which is dimensioned to accept and hold said one or more string saddles featuring geometry that matches with geometry of the base to facilitate assembly therewith without additional fasteners, the intonation saddles having different dimensions according to the desired pitch compensation for each string.

2. The adjustable compensated nut of claim 1, wherein the number of individual compensated intonation saddles are equal to the number of strings of the instrument.

3. The adjustable compensated nut of claim 1, wherein a single intonation saddle features compensation portions which are equal to the number of strings of the instrument.

4. The adjustable compensated nut of claim 1, further including one or more grooves extending along at least a portion of a top side of the nut, each of the grooves configured to receive one of the strings of the instrument.

5. The adjustable compensated nut of claim 4, wherein each of the grooves is aligned with one of the intonation portions.

6. The adjustable compensated nut of claim 1, wherein the intonation portions are cut-out or extended sections which have a depth between about 0.001 inches and about 0.150 inches.

7. The adjustable compensated nut of claim 1, wherein the intonation saddles feature extended sections which extend over the fingerboard of the instruments neck, the extended sections including a first side wall and a second side wall extending from the front side of the elongated base of the compensated nut.

8. The adjustable compensated nut of claim 7, wherein the side walls are generally parallel and the side walls are joined by a lower surface.

9. The adjustable compensated nut of claim 7, wherein the side walls are between about 0.010 inches and about 0.200 inches in length.

10. The adjustable compensated nut of claim 7, wherein the side walls are generally the same length and the side walls are joined by a curved lower surface.

11. The adjustable compensated nut of claim 1, wherein the intonation portions comprise a plurality of projections that extend outwardly from the nut base.

12. The adjustable compensated nut of claim 1, made from long fiber reinforced engineering resins.

13. The adjustable compensated nut of claim 12, wherein the percentage of long fiber reinforcement is 10% to 70%.

14. The adjustable compensated nut of claim 12, wherein the long fiber reinforcement is 0.5 mm to 25 mm in length.

15. The adjustable compensated nut of claim 12, wherein the long fiber is comprised of glass fiber, carbon fiber, aramid fiber, or basalt fiber.

16. The adjustable compensated nut of claim 12, wherein the base resin is comprised of PA66, PA12, PEEK, TPU, or PP.

17. The adjustable compensated nut of claim 12, wherein the base resin is modified by the addition of PFTE, graphite, or silicone.

18. A guitar or bass guitar, comprising: a body; a neck connected to the body; a bridge connected to the body; an adjustable compensated nut according to claim 1, connected to the neck.

19. The guitar or bass guitar of claim 18, wherein the bottom side of the nut base contacts the neck of the instrument and the front side of the nut base faces the body of the instrument.

20. A musical instrument neck with an adjustable compensated nut of claim 1, wherein the bottom side of the nut base contacts the neck of the instrument close to the head stock and the front side of the nut base faces portion of the neck to be mounted to the body of the instrument.

* * * * *